United States Patent [19]

Jackson et al.

[11] 4,144,937

[45] Mar. 20, 1979

[54] VALVE CLOSING METHOD AND APPARATUS FOR USE WITH AN OIL WELL VALVE

[75] Inventors: Gerald D. Jackson, Marlow, Okla.; Jim R. Williamson, Carrollton, Tex.; John C. Zimmerman, Duncan, Okla.

[73] Assignee: Halliburton Company, Duncan, Okla.

[21] Appl. No.: 861,758

[22] Filed: Dec. 19, 1977

[51] Int. Cl.[2] ..... E21B 43/12; E21B 47/00

[52] U.S. Cl. ..... 166/314; 166/315; 166/324; 166/332; 166/336; 251/58; 251/62

[58] Field of Search ..... 166/314, 315, 319, 321, 166/324, 332, 264; 137/629; 251/58, 62

[56] References Cited

U.S. PATENT DOCUMENTS

| | | | |
|---|---|---|---|
| Re. 28,131 | 8/1974 | Leutwyler | 137/629 |
| 3,856,085 | 12/1974 | Holden et al. | 166/324 X |
| 3,865,141 | 2/1975 | Young | 166/324 X |
| 3,868,995 | 3/1975 | Crowe | 137/629 X |
| 3,901,321 | 8/1975 | Mott | 166/321 X |
| 3,964,544 | 6/1976 | Farley et al. | 166/315 |
| 3,976,136 | 8/1976 | Farley et al. | 166/315 X |
| 4,064,937 | 12/1977 | Barrington | 166/321 X |
| 4,076,077 | 2/1978 | Nix et al. | 166/321 X |

*Primary Examiner*—Stephen J. Novosad

*Attorney, Agent, or Firm*—Floyd A. Gonzales; John H. Tregoning

[57] ABSTRACT

Disclosed is a tester valve having a ball valve rotatable between the open and closed positions for use with a test string to test an oil well. The apparatus includes a ball closing piston in the valve operating mechanism which assists in rotating the ball to the closed position. One side of the ball closing piston is exposed to a first pressure of formation fluid flowing through the interior of the test string on the upstream side of the ball valve. The other side of the piston is exposed to a second pressure which is lower than the first pressure by a pressure drop caused as the fluid flows through the apparatus past the ball being rotated to the closed position. A bypass mechanism is additionally disclosed which is operable for equalizing the pressure on both sides of the ball closing piston when the ball is being rotated to the open position.

8 Claims, 3 Drawing Figures

VALVE CLOSING METHOD AND APPARATUS FOR USE WITH AN OIL WELL VALVE

BACKGROUND OF THE INVENTION

This invention relates to a valve for use in an oil well and is useful in conducting drill stem tests of a submerged formation. More particularly, this apparatus relates to a closing means for utilizing formation pressure to supply closing force to rotate a ball valve to the fully closed position.

Tester valves are known in the art which utilize various control means to open and close a valve at the lower end of a drill stem for conducting a testing program of a subterranean formation in an oil well. Particularly advantageous arrangements are those shown in U.S. Pat. Nos. 3,856,085; 3,976,136; and 3,964,544 all of which are owned by the assignee of the present invention. These arrangements utilize pressure increases in the annulus of the oil well to open a ball valve in a tester valve apparatus. Spring means are further disclosed utilizing a mechanical spring and supplemented gas pressure to return the ball valve to a closed position when a pressure increase of annulus pressure is released.

The closing apparatus of the ball valves in these patents are arranged such that the return spring force and the pressure of the compressed gas is at its lowest point during the last increment of travel of the ball operating mechanism rotating the ball to the fully closed position. It has been found that fluid flow in the drill stem moving past the closing ball valve and ball valve seats in contact with the ball valve produce a "throttling effect" whereby a pressure drop is established across the ball valve.

This pressure differential may be sufficient to urge the closing ball valve into such tight engagement with the ball valve seat that sufficient force is not present in the spring means to complete the last increment of travel. Thus a fluid tight seal between the ball valve and the ball valve seat is prevented from being established.

In the apparatus of the present invention a valve closing means is disclosed whereby the mentioned pressure differential is utilized to effect the last incremental closing movement of the ball valve. A ball closing piston is disclosed wherein one side is exposed to the pressure in the drill stem below the ball valve, and a second side is exposed to pressure which exists in the tester valve apparatus having a lower value due to the mentioned throttling effect. As the ball valve is moved further toward the closed position, the orifice between the ball valve seat and the ball valve is made smaller and smaller thus increasing any pressure drop due to the fluid flowing between the ball valve and the ball valve seat. Thus, if the pressure drop becomes greater as the ball valve rotates to its fully closed position, the pressure differential across the ball closing piston increases thereby increasing the closing force attempting to rotate the ball to its fully closed position.

A bypass arrangement is disclosed for exposing both sides of the ball closing piston to the pressure in the drill stem below the closed ball valve when the valve operating mechanism is actuated for rotating the ball valve toward the open position.

THE DRAWINGS

A brief description of the appended drawings follows:

FIG. 1 provides a schematic "vertically sectioned" view of a representative offshore installation which may be employed for formation testing purposes and illustrates a formation testing string or tool assembly in position in a submerged well bore, and extending upwardly to a floating operating and testing station.

FIGS. 2*a* and 2*b* joined along section line a—a illustrate the apparatus of the invention including a portion of a tester valve having a ball valve mechanism, a power means and a ball valve operating means, having a formation pressure actuated ball closing means.

DESCRIPTION OF THE PREFERRED EMBODIMENT

Figure 1:
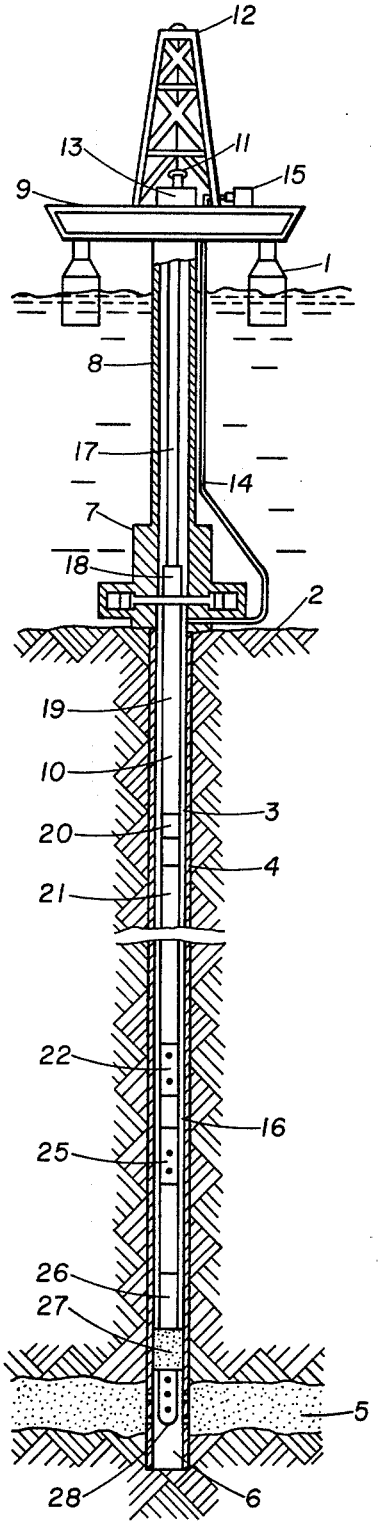

Shown in FIG. 1 is an offshore oil well drill stem test wherein the invention disclosed herein may be used. The offshore well includes a floating work station 1 having a work deck 9 on which is mounted a derrick 12. The floating work station 1 is centered over a submerged work site 2 having a well bore 3 extending from the submerged work site 2 to a submerged formation 5 to be tested. The well bore 3 is normally lined with a casing string 4 which is cemented into place. Well fluid in the submerged formation 5 is admitted through the casing string 4 by perforations into the well bore interior g. At the submerged work site 2 is a well head installation 7 which includes blowout preventers and is connected by a marine conductor 8 leading from the submerged well head installation 7 to the work deck 9 of the floating work station 1.

A test string 10 is lowered into the well bore 3 through the marine conductor 8 and extends from the open end 13 of the marine conductor 8 to the submerged formation 5 to be tested. A hoisting means 11 is connected to the upper end of the test string 10 and is used for raising and lowering the test string 10 in conjunction with derrick 12. The test string 10 includes an upper conduit string 17 extending from the open conductor end 13 to the well head installation 7 and may have a test tree 18 which is supported in the well head installation 7 which may be hydraulically operated to open and close a fluid passageway through the test string 10. Below the well head installation 7 is an intermediate conduit 19 which includes a slip joint 20. This slip joint 20 is preferably of a volume and pressure balanced design such that wave motion of the floating work station 1 may be absorbed as the test string is being lowered into the well before the test tree 18 is landed in the well head installation 7. Below the slip joint 20 is an intermediate conduit portion 21 which may extend from the slip joint 20 to a circulation valve 22. Below the circulation valve 22 is a tester valve 25 below which is a pressure recording device 26. A packer 27 is at the lower end of the test string. By manipulation of the test string 10, the packer 27 may be expanded to form a fluid tight seal in the annulus 16 between the casing string 4 and the testing string 10. A perforated tail piece 21 is located at the lower end of the test string to allow formation fluid from formation 5 to enter into the flow channel through the center of test string 10.

During the drilling of an oil well, the well bore is filled with a fluid known as drilling mud which is weighted such that its hydrostatic pressure at formation depth is higher than the pressure of the fluid in the well formation for maintaining the formation fluid in the formation.

To evaluate a formation, a testing string 10 is lowered into the well bore with a tester valve 25 in the closed position such that a lower pressure will exist in the flow channel through the center of the testing string 10. The packer 27 is then set and the tester valve 25 is opened. The formation fluid, freed from the restraining pressure of the drilling mud by packer 27, is free to flow through the perforated tail piece 28 and into the flow channel through the center of the testing string 10. A pressure recording device 26 records pressures which exist in the flow channel through the testing string throughout the testing operation as the tester valve 25 is alternated between the open and the closed position. These pressure recordings are then used to evaluate the production capability of the submerged formation 5 being tested.

As the testing string 10 is lowered into the well bore 3 and before the test tree 18 is landed in the well head installation 7, the slip joint 20 absorbs wave motions of the floating work station 1. After the test tree 18 is landed in the well head installation 7, the packer 27 is set by appropriate manipulation of the test string 10 and wave motion may then be absorbed by the upper conduit string 17 moving with respect to the floating work station 1.

In offshore installations the blowout preventers in the well head installation 7 are preferably maintained in the closed position for ecological and safety reasons. It is then desirable that the tester valve 25 and the circulation valve 22 be operated by changing the fluid pressure in the well annulus 16. Such annulus pressure changes may be effected by a hydraulic pump 15 at the work deck 9 connected to a supply conduit 14 which is introduced into the well bore 3 below the closed blowout preventer rams in the well head installation 7.

At the end of the formation test, the tester valve 25 may be closed and the circulation valve 22 opened to allow drilling fluid to be pumped through the now open circulation valve from the well annulus 16 to the flow channel in the interior of the testing string. Formation fluid trapped in the flow channel of the testing string above closed tester valve 25 may then be pumped to the surface and safely disposed of. The circulation valve, now in the open position, also acts as a drain as the testing string 10 is removed from the well bore such that fluid in the interior of the test string may drain from the test string conduit 10 as the test string is removed from the well bore.

The preferred tester valve 25 is one such as disclosed in the aforementioned U.S. Pat. No. 3,856,085 issued Dec. 24, 1974 to Holden et al. and owned by the assignee of the present invention. This preferred tester valve may include a pressure operated isolation valve for supplementing spring pressure in the tester valve with well annulus pressure as the tester valve is lowered into the well bore 3 at the end of testing string 10. Such a pressure operated isolation valve is disclosed in the aforementioned U.S. Pat. No. 3,976,136 issued Aug. 24, 1976 to Farley et al. or that disclosed in the aforementioned U.S. Pat. No. 3,964,544 issued June 22, 1976 to Farley et al., both of which are owned by the assignee of the present invention.

Figure 2A:
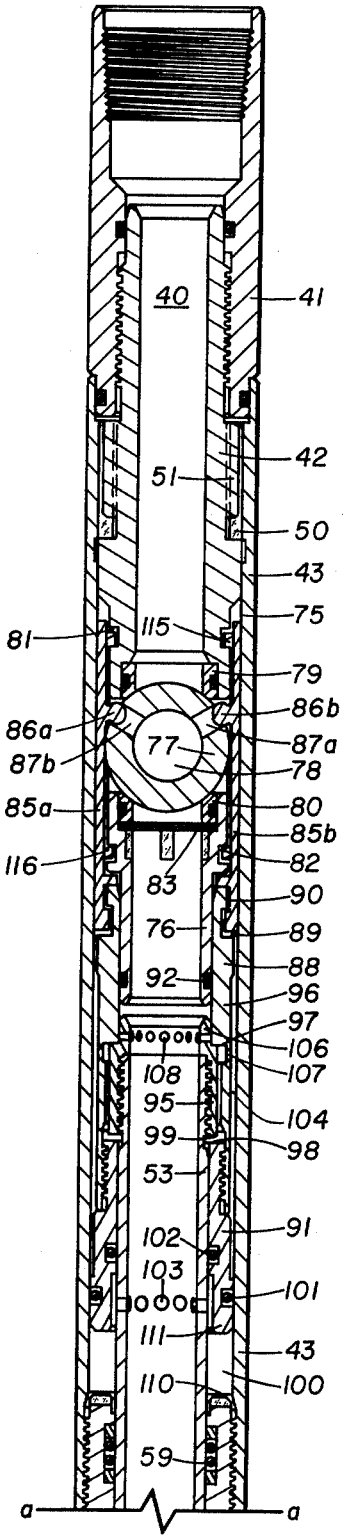
Figure 2B:
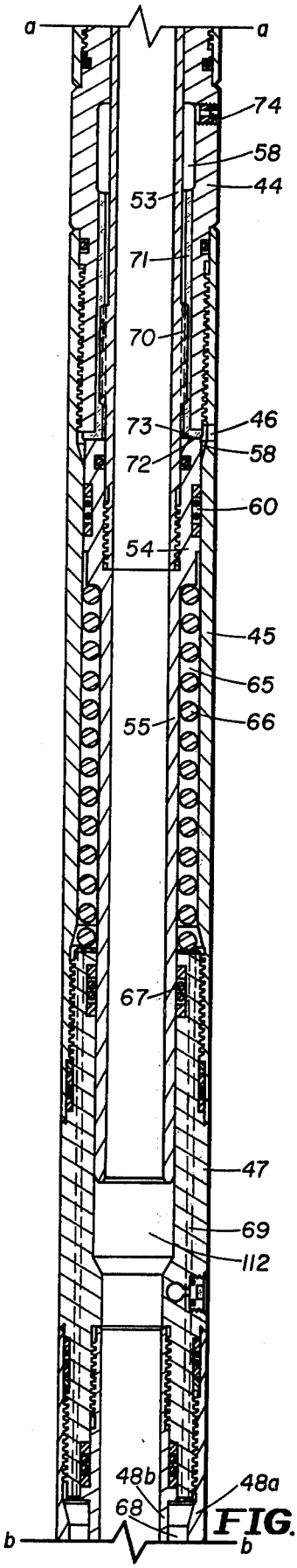

The preferred tester valve 25 is illustrated in part in FIGS. 2*a* and 2*b*. The preferred tester valve 25 includes a tubular outer housing assembly having an open bore 40 therethrough.

The outer housing assembly includes an upper housing adapter 41, an upper ball retaining sleeve 42, a ball section housing 43, an upper intermediate housing 44, a spring section housing 45 having power port 46, a lower intermediate housing 47, and a gas chamber housing including an outer housing portion 48*a*, and an inner housing portion 48*b*. From this point downward the preferred tester valve 25 may be, for instance, the lower portion of the apparatus disclosed in any one of U.S. Pat. No. 3,856,085, U.S. Pat. No. 3,976,136 and U.S. Pat. No. 3,964,544 wherein the gas chamber housing portions 48*a* and 48*b* may be the generally tubular housing means 122 shown in FIG. 2*b* of the respective patents.

Splines 50 on ball section housing 43 interconnect with splines 51 on the upper ball valve retaining sleeve 42 to assist in the assembly of the apparatus by preventing rotary motion between ball valve housing section 43 and ball retaining sleeve 42.

Slidably located in the inner bore 40 of the tester valve apparatus 25 is an inner sliding mandrel assembly having a power mandrel 53, a power piston 54, and a follower mandrel 55. The inner mandrel assembly is spaced within the outer mandrel assembly such that a power chamber 58 appears therebetween with power port 46 being above the upper end of power mandrel 54 as shown in FIG. 2*b*. A sealing means 59 is provided between the power mandrel 53 and the upper intermediate housing section 44 to prevent fluid communication between the power chamber and the inner bore 40. Sealing means 60 is provided in the power piston 54 to prevent fluid communication past the power piston 54 from power chamber 58.

A spring means is provided in the apparatus for moving the inner mandrel assembly upwardly in opposition to a force developed by well annulus pressure which is admitted to power chamber 58 through power port 46. This spring means includes a gas filled chamber 65 and a mechanical spring 66 therein which is positioned between the lower side of power piston 54 and the upper face of tubular housing section 47 as shown in FIG. 2*b*. A sealing means 67 is located between the housing section 47 and the follower mandrel 55 to prevent fluid communication between the compressed gas chamber 65 and the inner bore 40 of the apparatus. The spring means of the present apparatus also includes a main gas chamber 68 and a passageway 69 providing fluid communication between gas chamber 65 and main gas chamber 68.

The lower portion of main gas chamber 68 may include means to supplement the gas pressure as the apparatus is lowered into the well bore as disclosed in the aforementioned U.S. Pat. Nos. 3,856,085, 3,976,136 or 3,964,544.

Splines 70 on power mandrel 53 interconnect with splines 71 on housing section 44 to assist in the assembly of the apparatus and to prevent rotating motion of the power mandrel 53 with respect to the outer tubular housing assembly of the apparatus. The upward directed face 72 of the power piston 54 engages with downward directed face 73 of splines 71 to limit upward travel of the power piston 54 responsive to the spring means.

A cleanout plug 74 is provided through the walls of upper intermediate housing section 44 to provide for cleaning out the power chamber 58 between the cleanout plug 74 and the power port 46 without disassembly of the tool. It should be noted that power port 46 may be located at any point in the outer housing assembly between the present position of the power port 46 shown in FIG. 2*b* and the cleanout plug 74 as desired.

The tester valve mechanism shown in FIG. 2*a* is located in an enlarged inner bore 75 in the outer housing assembly. The tester valve mechanism includes a lower ball retaining sleeve 76 below the upper retaining sleeve 51 and has a ball 77 located therebetween as shown. A central bore 78 is provided through ball 77 and may be moved by rotation of the ball to a position wherein the central bore 78 is aligned with the central bore 40 through the apparatus for fluid communication through the ball valve, or may be rotated such that the central bore 78 is transverse to the central bore 40 such that ball 77 blocks fluid passage through the central bore 40. An upper ball seat 79 is provided to sealingly engage ball 77 with upper ball retaining sleeve 42. A lower ball valve seat 80 is provided below the ball 77 and the lower ball retaining sleeve 76. A groove 81 is provided in upper sleeve 42 for C-clamps 115 and 116 and a groove 82 is provided in lower sleeve for the same C-clamps. The C-clamps 115 and 116 may be fitted into the grooves 81 and 82 and extend therebetween to hold the ball 77. Belleville springs 83 are provided below lower ball seat 80 and the lower ball retaining sleeve 76 so as to urge the ball seats 79 and 80 into ball 77.

A fluid tight seal is established in the illustrated embodiment between upper ball seat 79 and the ball 77 when the ball 77 is rotated to the closed position. It may be seen in the later discussion, that the pressure which exists in the central bore 40 below the closed ball 77 will also exist in the bore 75 surrounding the ball. Thus, lower ball valve seat 80 acts as a rotating surface to hold ball 77 in position between retaining sleeves 42 and 76. Belleville springs 83 urge ball 77 into sealing engagement with upper valve seat 79. Also, if a higher pressure exists in the central bore 40 below the closed ball this higher pressure will tend to urge the closed ball 77 into ball valve seat 79 to effect a fluid tight seal.

A ball operating means is provided in bore 75 surrounding ball 77 and extending therebelow for engagement with the sliding mandrel assembly previously described. The ball operating means includes pin arms 85*a* and 85*b* having pins 86*a* and 86*b* extending into holes 87*a* and 87*b* in the ball 77. The pin arms are spaced to be intermediate the C-clamps 115 and 116 as is known in the art. The design of the C-clamps 115 and 116 and the pin arms 85*a* and 85*b* and their arrangement is disclosed in aforementioned U.S. Pat. No. 3,856,085. An operating mandrel 88 having grooves 89 is below and coengaged with pin arms 85*a* and 85*b* by means of groove 90 in the mentioned pin arms 85*a* and 85*b*. A ball closing piston 91 is on the end of operating mandrel 88. Seal means such as O-ring 92 is provided between the lower ball retaining sleeve 76 and the operating mandrel 88. This O-ring is optional in the illustrated embodiment and serves mainly to prevent drilling mud flow which might contaminate or restrict the movement of operating mandrel 88.

Means are provided for interconnecting the inner sliding mandrel assembly to the ball operating means to push and pull the ball operating mechanism for rotating the ball 77 between the open and closed positions. This interconnecting means includes an end collar 95 on the end of power piston 53. This end collar 95 may push the operating mechanism upwardly when the upward directed face 97 on the collar is engaged with thickened portion 96 of the operating mandrel. When the inner sliding mandrel is moved downwardly, the upper end 98 of an extension of piston 91 is engaged with the lower face of end collar 95 such that the end collar 95 may pull the operating mechanism downwardly with the inner mandrel assembly.

It can thus be seen that when well annulus pressure is increased, this increased pressure will be admitted to power chamber 58 through power port 46. This increased pressure acting on the upper end 72 of power piston 54 will move inner mandrel assembly downwardly against the mechanical spring 66 and the supplemented gas pressure in gas chambers 65 and 68, compressing the spring 66 and the gas therein. This downward motion will engage faces 99 and 98 to pull the operating mechanism downwardly for rotating the ball 77 to the open position. When the well annulus pressure is reduced, the inner mandrel assembly will slide upwardly responsive to the compressed mechanical spring 66 and the increased gas pressure of the gas in chambers 65 and 68 until limited by the engagement of end 72 with face 73. This upward movement will engage face 97 with the thickened portion 96 of the operating mandrel 88 to move the operating mechanism upwardly for rotating the ball 77 to the closed position.

When there is formation flow through the inner bore 40 of the apparatus and through the bore 78 of the ball 77, increasing pressure will be needed to rotate the ball in the closed direction as the orifices between the bore 78 and the valve seats 88 and 79 become smaller. However as the inner mandrel moves upwardly to the nearly uppermost position, the mechanical spring 66 will be to its almost fully extended position and the gas pressure of the compressed gas in chambers 65 and 68 will decrease as the inner sliding mandrel assembly moves upwardly such that when the most force is needed to complete the last incremental movement of ball 77 to the fully closed position, the forces available from the spring means will be at their lowest point.

Thus, a ball closing means has been included in the valve for moving the ball to its fully closed position. This ball closing means is inactivated or bypassed when the ball is being moved from the closed position to the open position. The ball closing means includes annular chamber 100 which allows for reciprocal movement of ball closing piston 91. Sealing means 101 and 102 are located in ball closing piston 91 to prevent fluid communication from one side of ball closing piston 91 to the other side. A plurality of ports 103 are provided through power mandrel 53 for communicating fluid pressure from the inner bore 40 to the chamber 100. A portion 104 of the enlarged bore 75 conducts fluid pressure present in the enlarged bore 75 from around the ball 77 to one side of the ball closing piston 91. It will be noted that pin receiving holes 87*a* and 87*b* allow fluid to communicate between the inner bore 78 of the ball 77 and the enlarged bore 75 around the exterior of ball 77.

It will be understood that when there is fluid flow in the interior bore 40 of the apparatus from below the ball 77 to above the ball 77 as the ball is rotated to the near closed position, there will be a pressure drop as the flow moves past lower ball seat 80 into inner bore 78. There will be another fluid pressure drop as the fluid moves out of inner bore 78 past upper ball seat 79 back into the inner bore 40. The intermediate pressure which is present in the inner bore 78 of the ball 77 will be transmitted through pin receiving holes 87*a* and 87*b* as well as inner bore 78 into the enlarged bore 75 and communicated by bore portion 104 to one side of ball closing piston 91. The higher pressure present in the inner bore 40 below the ball 77 will be communicated from the inner bore 40 through ports 103 into annular chamber 100 to the other side of ball closing piston 91. Thus it can be seen that as the pressure drop across lower ball valve seat 80 increases, that this increasing pressure differential will be transmitted back to ball closing piston 91 to increase the force which is attempting to rotate the ball 77 to the closed position.

A bypass means is provided to equalize the pressure across ball closing piston 91 when the ball valve is being rotated from the closed to the open position. This bypass means includes a lip 106 on the end collar 95 which is designed to extend over the thickened portion 96 of operating mandrel 88. The lip in the disclosed embodiment is not particularly designed to provide a fluid tight seal between inner bore 40 and enlarged bore portion 104, but should have enough engagement to ensure that a pressure drop does exist between inner bore 40 and enlarged bore portion 104. A plurality of ports 107 are provided in operating mandrel 88 and a corresponding plurality of ports 108 are provided in end collar 95. When end collar 95 is engaged with the operating mandrel 88 as shown in FIG. 2*a* the ports 108 and 107 are out of register such that a pressure differential can exist between inner bore 40 of the apparatus and enlarged bore portion 104. A space is provided between faces 98 and 99 to allow lost motion before the ball valve operating mechanism is engaged to begin opening the ball valve 77. This lost motion allows for end collar 95 to move downwardly such that ports 107 and 108 are aligned to remove any pressure differential which may exist across ball closing piston 91. The ports 107 and 108 further act as a strainer to prevent large particles of contaminants which might be suspended in the drilling mud from flowing between the ball operating mechanism and the outer housing assembly such that the ball operating mechanism will not be blocked or restricted.

A travel limit means is provided to stop rotation of the ball after a predetermined distance to ensure that the ball is rotated to the fully open position and that the bore 78 through the ball 77 will be correctly aligned with the open bore 40 through the apparatus. This stop is provided by upward directed face 110 of the upper extension of housing section 44 and the downward directed face 111 of one side of the ball closing piston 91. An alternate location for the travel limit means may be between the lower end of follower mandrel 55 and the lower intermediate housing section 47. The opening distance between the faces 110 and 111 is to be preferred because of machine tolerance considerations.

It can thus be seen that a ball closing pressure assist is provided to close a tester valve wherein the force for closing the valve is increased as a pressure drop across the closing valve is increased during the closing process. A bypass arrangement is additionally included for bypassing the ball closing pressure assist as the valve is moved toward the open position.

It may be desired to provide a bypass around the closed ball 77 to equalize any pressure difference across the ball prior to opening the closed ball 77. In this case, a bypass passage may be provided through upper ball retaining sleeve 42 for providing fluid communication between the bore 40 above the ball 77 and the enlarged bore 75 around the exterior of ball 77.

A sealing means would also be provided between the end collar 95 and the thickened portion 96 of the operating mandrel 88. This sealing means would be arranged to seal when the face 97 is engaged with thickened portion 96 for closing the bypass around the ball 77, and arranged to allow flow through ports 107 when faces 98 and 99 are engaged and the ball 77 is being rotated to the open position. In this case a fluid tight seal would be established between ball 77 and seat 80 when the ball 77 is in the closed position. The bypass means would both provide for a bypass around ball 77, and serve to equalize the pressure across ball closing piston 91 when the mentioned bypass is in the open position.

The foregoing disclosure is intended to be illustrative only and is not intended to cover all embodiments that may occur to one skilled in the art to accomplish the foregoing objectives. Other embodiments which work equally well and are equivalent to the embodiments shown may be imagined by one skilled in the art.

The attached claims are intended to cover the embodiments disclosed as well as such equivalent embodiments of the invention which may occur to one skilled in the art.

What is claimed is:

1. In an apparatus for use in conducting an oil well test wherein the apparatus opens and closes a flow channel in a test string in the oil well extending from the surface to the formation to be tested and includes a valve means for opening and closing the flow channel, opening force supplying means operable from the surface, closing force supplying means for supplying force to close the valve means when the opening force is removed, and valve operating means connecting said opening force supplying means and said closing force supplying means to said valve means for opening and closing said valve means; the improvement comprising:

valve closing means in said valve operating means operable responsive to a pressure differential established by fluid flow through said flow channel past said valve means as said valve means is moving toward the closed position for assisting said closing force supplying means in supplying force to said valve operating means for moving said valve means to the closed position.

2. The improvement of claim 1 further comprising bypass means operable responsive to the force exerted by the opening force supplying means for bypassing said valve closing means when said valve operating means is opening said valve means.

3. The apparatus of claim 1 wherein the valve means comprises a ball having a bore therethrough and rotatable between a closed position wherein the bore is transverse to the flow channel through said test string and an open position wherein the bore is aligned with said flow channel to allow fluid flow therethrough; the valve closing means further comprising:

a piston in said valve operating means for transmitting closing force to said valve operating means;

means for transmitting to one side of said piston, fluid pressure from a portion of the flow channel of said test string between the valve means and the formation to be tested; and means for transmitting fluid pressure from the open bore through said ball to the other side of said piston when said operating means is rotating said ball to the closed position.

4. The improvement of claim 3 further comprising means in said operating means operable for providing fluid communication from said flow channel portion to said other side of said piston during movement of said operating means in the opening direction responsive to said opening force supplying means.

5. The method of closing a valve in the flow stream of formation fluid flowing through a tubing string extending from an oil well formation to the surface comprising:

starting to close a valve controlling fluid flow through the tube string responsive to a closing force;

creating a zone of lower pressure on the down stream side of a portion of the valve restricting the flow of the fluid through said tubing string;

transmitting the pressure of the formation fluid on the upstream side of said valve to one side of a piston, and the pressure of said zone to the other side of a piston for creating a force responsive to the differential between said pressures;

assisting the closing force with said created force for continuing to close said valve; and completing the closing of said valve responsive to said assisted closing force.

6. An apparatus for conducting an oil well formation test with a tubular testing string comprising:

a tubular housing for incorporation into said tubular testing string and having an open flow channel therethrough;

a tubular inner sliding mandrel slidably located in said tubular housing arranged for longitudinal movement in a first direction responsive to an opening force, and for longitudinal movement in a second opposite direction responsive to the closing force of a spring means compressed during the movement of said inner mandrel in said first direction;

a ball valve in said tubular housing having a ball with a central bore therethrough operably arranged for rotation between a closed position having said central bore transverse to the flow channel through said tubular housing, and an open position having said central bore aligned with said tubular housing flow channel for allowing fluid flow through said flow channel and the aligned bore of said ball;

operating means operatively connecting said tubular inner sliding mandrel to said rotatable ball for rotating the ball to the open position when said inner mandrel moves in said first longitudinal direction, and for rotating the ball to the closed position when said inner mandrel moves in said second longitudinal direction; and piston means between said tubular inner mandrel and said tubular housing and exposed on one side to the pressure of fluid in the flow channel through said tubular mandrel, and exposed on the other side to the pressure of fluid in the central bore of said ball, said piston means arranged for assisting said tubular inner mandrel to move in said second longitudinal direction responsive to a pressure differential across said piston.

7. The apparatus of claim 6 further comprising means for transmitting the pressure of fluid in the central bore of said ball to an area exterior of said ball between said ball and said tubular housing walls; and fluid conduit means between said tubular housing walls and said operating means for transmitting said central bore pressure from said area exterior of said ball to the other side of said piston means.

8. The apparatus of claim 6 further comprising bypass means in said operating means operatively arranged for communicating the pressure of fluid in the flow channel through said tubular inner mandrel to the other side of said piston means when said tubular inner mandrel moves in said first longitudinal direction.

* * * * *